US005218160A

United States Patent [19]

Grob-Da Veiga

[11] Patent Number: 5,218,160

[45] Date of Patent: Jun. 8, 1993

[54] STRING INSTRUMENT SOUND ENHANCING METHOD AND APPARATUS

[76] Inventor: Matthias Grob-Da Veiga, Haldenstrasse 27, 2502 Biel/Bienne, Switzerland

[21] Appl. No.: 840,733

[22] Filed: Feb. 19, 1992

[30] Foreign Application Priority Data

Feb. 28, 1991 [CH] Switzerland ..... 00607/91

[51] Int. Cl.[5] ..... G10H 1/08; G10H 1/18; G10H 1/46

[52] U.S. Cl. ..... 84/735; 84/741; 84/742

[58] Field of Search ..... 84/645, 735, 736, 741, 84/742

[56] References Cited

U.S. PATENT DOCUMENTS

| | | | |
|---|---|---|---|
| 3,591,699 | 7/1971 | Cutler | 84/736 |
| 3,651,242 | 3/1972 | Evans | 84/736 X |
| 5,099,738 | 3/1992 | Hotz | 84/645 X |

*Primary Examiner*—Stanley J. Witkowski
*Attorney, Agent, or Firm*—Walter C. Farley

[57] ABSTRACT

A sound enhancing apparatus for use with a string instrument has separate tone pick-ups for picking up the tones of individual strings and circuits for, determining the fundamental tones of these tones, multiplying the frequencies of these fundamental tones by small integers and/or dividing them by small integers and consequently producing harmonic overtones and/or undertones. The thus produced harmonic undertones and/or overtones are selected and amplified according to fixed and/or adjustable criteria and finally admixed with the original sound. The electronic apparatus for performing the process can operate in analog or digital manner.

12 Claims, 6 Drawing Sheets

STRING INSTRUMENT SOUND ENHANCING METHOD AND APPARATUS

FIELD OF THE INVENTION

The invention is in the field of electronic music production and relates to a process and an apparatus by, with which it is possible to extend the sound impression of mechanically produced and electronically amplified sounds, particularly those of a solid-body guitar.

BACKGROUND OF THE INVENTION

It is known to electronically amplify mechanically produced sounds. It also is known to produce new sounds or tones with a new timbre from mechanically produced sounds by mixing in electronically produced, harmonic tones, such as is e.g. described in DE-OS 26 56 298. However, this mixing is always associated with a time lag, because the electronic system must analyze the mechanically produced tones and must synthesize the additional tones.

The known, electronic harmonic generators and the like can simultaneously produce additional overtones and undertones, but in the case of a played chord, the whole chord is processed as a sound.

It would be desirable for each individual tone of a played chord to simultaneously extend the sound impression by additional, harmonic undertones and/or overtones. As a result sounds could be produced, which could not be produced either purely electronically, or purely mechanically. In particular, such a system would be desirable for a solid-body guitar, whose sound can decay over a very long period as a result of the complete omission of a sound board, but loses fullness as a result of the lack of the "tones" of this sound board.

Due to the lack of resonances and interferences and in particular tones, which are lower than the played fundamental tone, the amplified guitar has a downwardly limited sound impression. Up to now the undertones and overtones have been created by monophonic electronic limitation. However this leads to aggressively sounding, unharmonic interferences and playing is restricted to simple harmonic intervals. The electronic limitation of the sounds of individual strings avoids unharmonic interferences, but only creates overtones and no undertones.

SUMMARY OF THE INVENTION

An object of the invention is to electronically enrich the sound of a string instrument, particularly a solid-body guitar, in such a way that for a constant, long decay it exceeds as regards fullness and colour richness the sound of the solid-body guitar and also the acoustic guitar i.e. a long decaying, but still full and overtone-richer (and/or undertone-richer) full sound is obtained, which cannot be produced with either the acoustic guitar or the solid-body guitar. The apparatus to be used for enriching the timbre is intended to make it possible for the musician to modulate the timbre within certain limits. The apparatus is to be constructed in such a way that it can be fitted into any string instrument and can also be connected to any standard amplifier system or mixing console.

BRIEF DESCRIPTION OF THE DRAWING

A process and apparatus in accordance with the invention are to the independent apparatus claim. The process and apparatus are described hereinafter relative to the drawings, wherein:

DESCRIPTION OF THE PREFERRED EMBODIMENTS

The principle of the inventive process is to pick up the tones of individual strings using separate pickups, to determine the fundamental tones thereof, to multiply these fundamental tones with simple fractions, e.g. ½, 3/2, ¼, and 2/1 and consequently produce harmonic overtones and/or undertones. The resulting harmonic undertones and/or overtones are selected and amplified according to fixed and/or adjustable criteria and finally mixed with the original sound.

Figure 1:
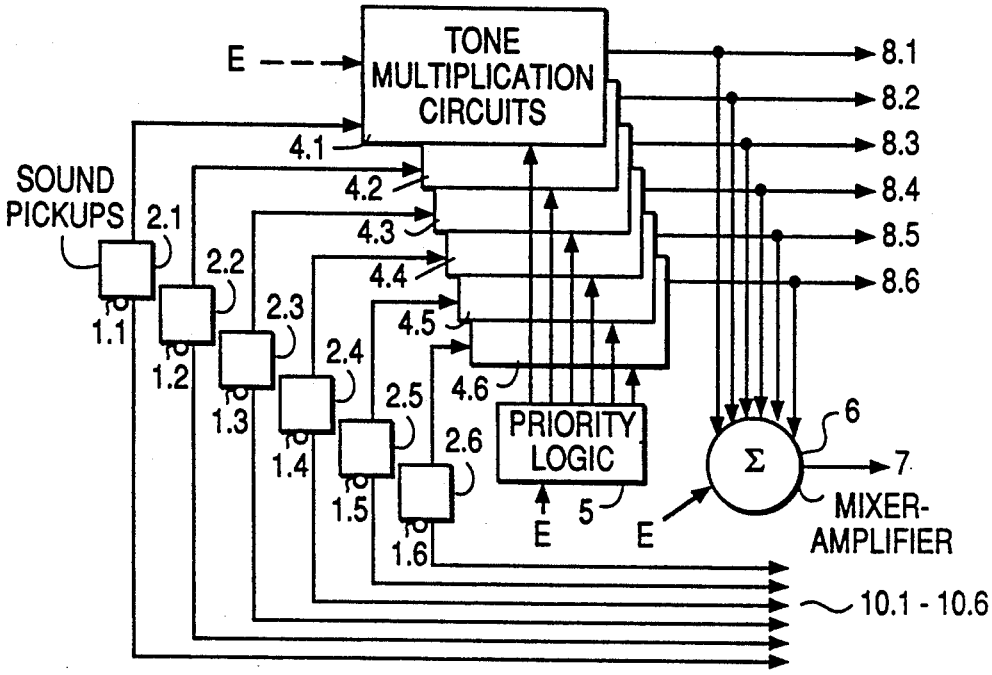
FIG. 1 is a schematic block diagram illustrating the inventive process.

FIG. 1 is a schematic block diagram showing the principle of the inventive process. The tones of e.g. each individual guitar string 1.1 . . . 6 are picked up by a corresponding pick-up 2.1 . . . 6 (hexaphonic pick-up) and in their original form are passed in the conventional manner to the outputs 10.1 . . . 6, where they can be tapped for electronic amplification or for some other electronic processing station such as a mixing console. In addition, the tones picked up from the strings are each individually supplied to one of a group of circuits 4.1 . . . 6, in which by single or multiple multiplication of their frequencies with simple fractions, are converted into harmonic overtones and/or undertones. For example, each of the fundamental tones of the picked-up string tones is processed by halving the basic frequency to produce an undertone one octave below the fundamental tone. The intensities of these undertones and/or overtones and the time patterns of the intensities are is determined on the one hand by the intensity of the tone picked up from the corresponding string and on the other by a priority logic 5. By means of adjustable and/or fixed criteria, the priority logic 5 determines the selection and intensity of the different undertones and/or overtones of a played chord. The function of such a priority logic will be described in greater detail relative to an example in conjunction with FIG. 3.

The overtones and/or undertones at the outputs of the electronic circuits 4.1 . . . 6 can be passed to a mixer/amplifier 6 which can then be tapped at its output 7 for further processing. The further processing can consist of mixing the signals with the original string tones and amplifying them together, or separately supplying them to a mixing console. The overtones and/or undertones produced by the tones of the individual strings can also be supplied to separate outputs 8.1 . . . 6 and individually further processed.

The timbre of a tone formed from an original tone played on a string and overtones and/or undertones produced therefrom is dependent on the choice of the overtones and/or undertones, the intensity thereof compared with the overall intensity and the time behaviour of this intensity compared with the time behaviour of the intensity of the original tone (envelope curve). The timbre of a chord formed from different tones played on different strings and the overtones and/or undertones produced therefrom is additionally dependent on the choice of the overtones and/or undertones of the individual strings determined by the priority logic and by the relative weight thereof in the sound at the output 7 which is determined by the mixer 6, apart from the already mentioned criteria for each individual tone. In order that the musician can modulate this timbre, he can adjust the mixer/amplifier 6 and/or the priority logic 5 (arrows E).

In alternative arrangements, the played tones of all the strings are not picked up for producing overtones in which case or undertones and the mixer/amplifier 6 is omitted. The modulation of the timbre is brought about solely by adjusting the priority logic. There need also be no adjustability of the priority logic 5, so that the modulation of the timbre is possible solely via the mixer/amplifier 6 and is correspondingly limited.

For preferred embodiments of the inventive apparatus the action possibilities by the musician are so limited that with a maximum number of sound variations a very easily operatable apparatus is obtained, which negatively affecting can easily be fitted to a solid-body guitar without the handling of the instrument.

Figure 3:
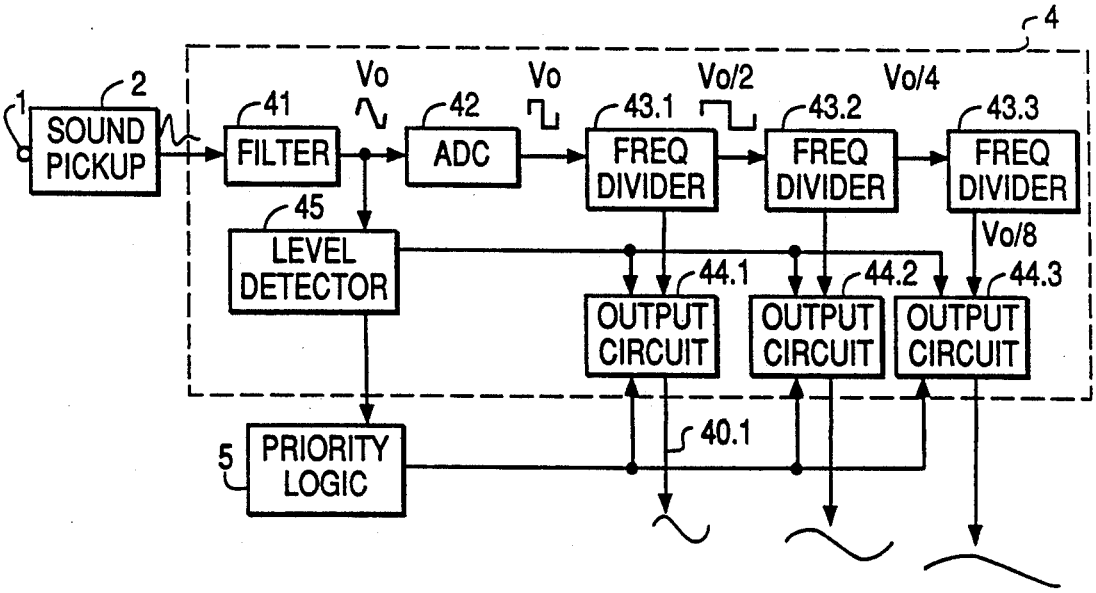
FIG. 3 is a more detailed schematic block diagram of one embodiment of the invention.
Figure 4:
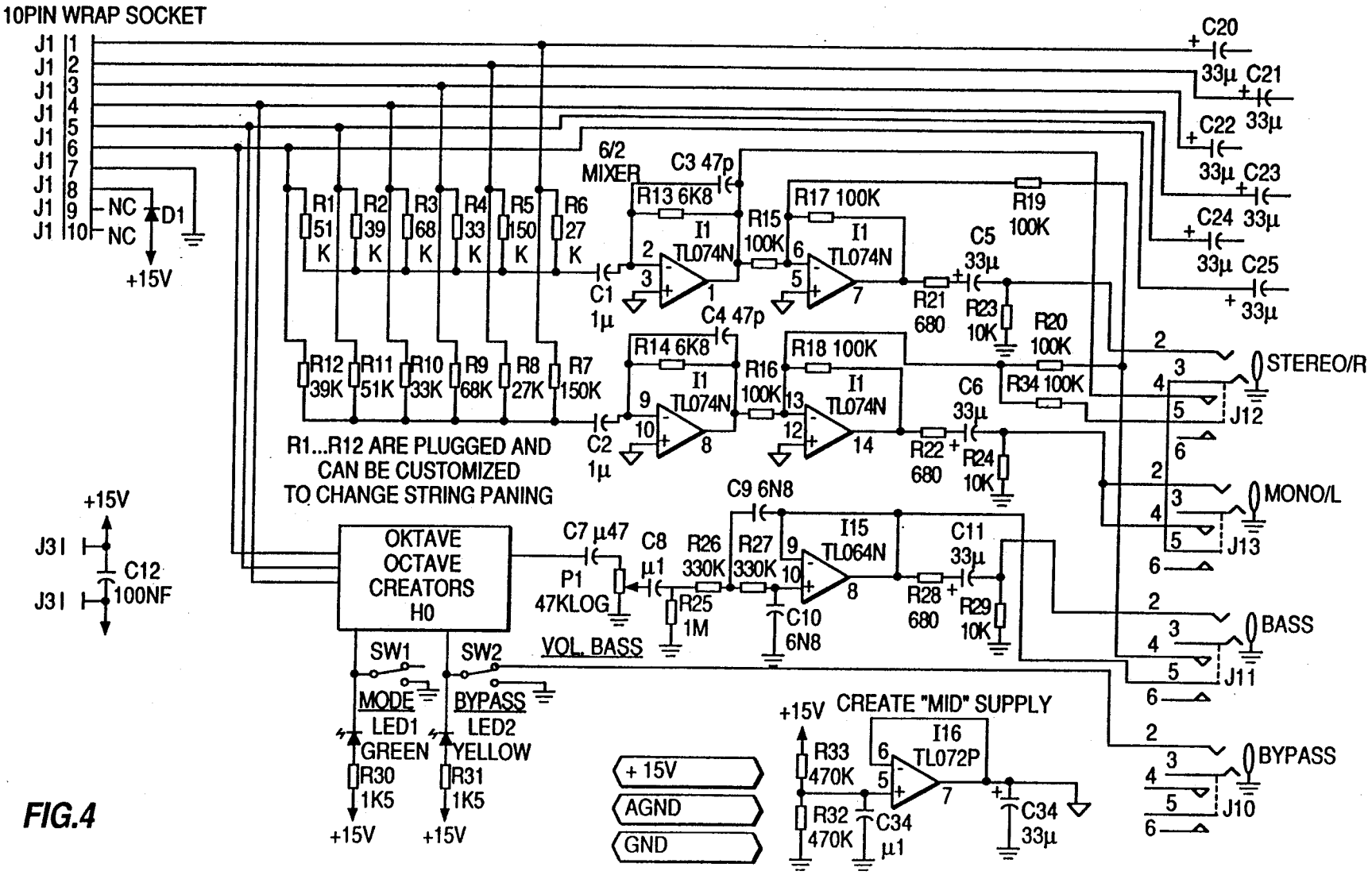
FIG. 4 is a schematic electronic circuit diagram for an electronic guitar with the inventive apparatus as a black box.
Figure 5A:
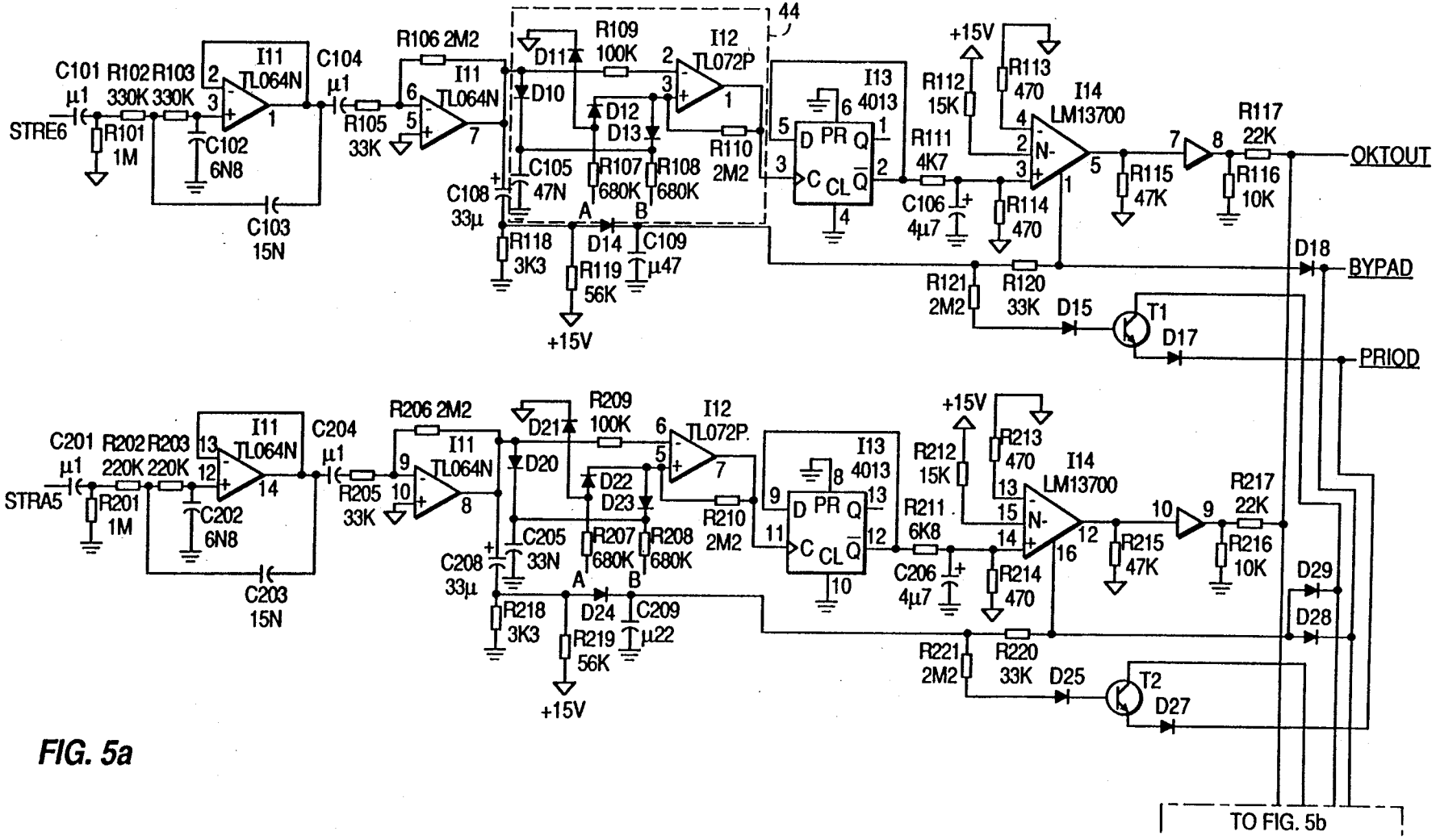
FIG. 5 is a schematic electronic circuit diagram for an embodiment of the inventive apparatus.
Figure 5B:
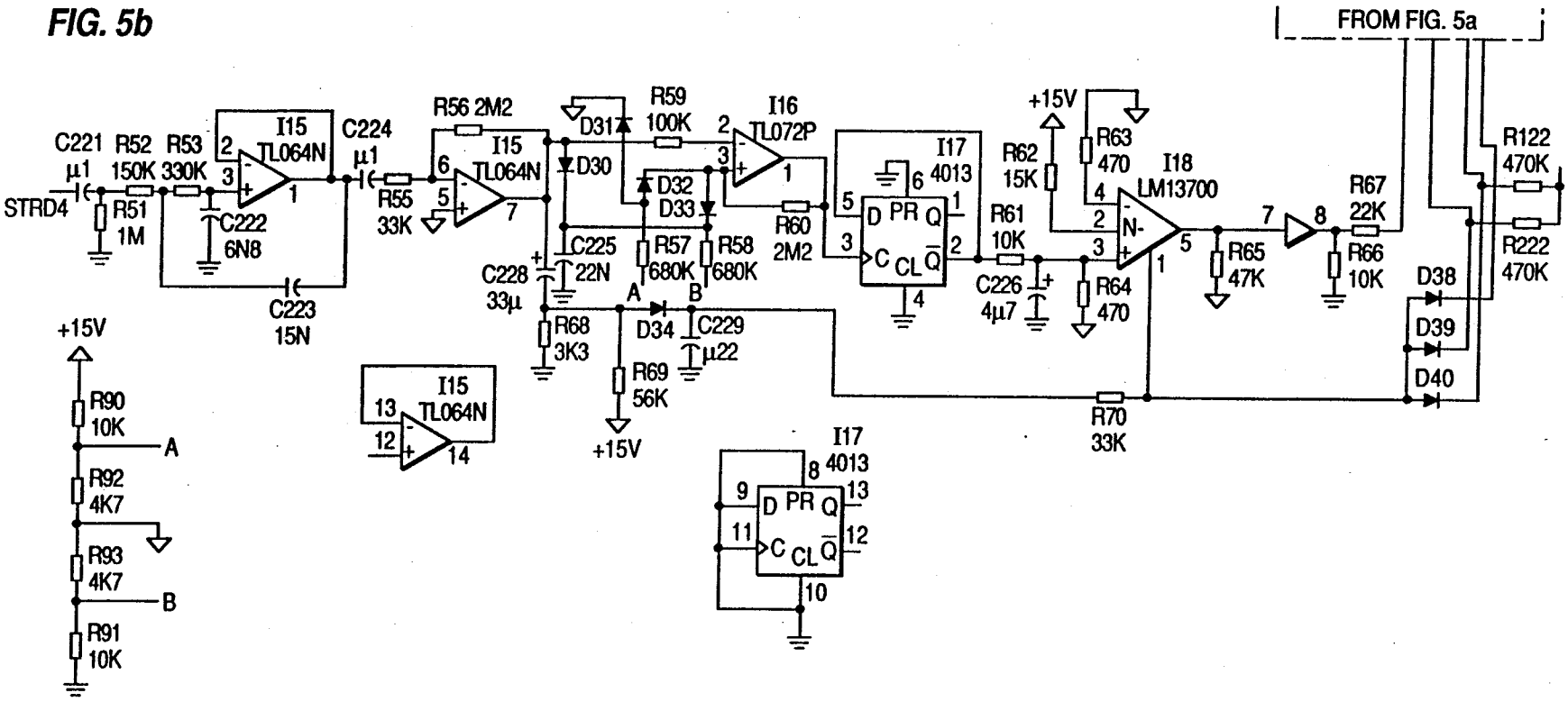

A variation on the above (FIGS. 2 and 3) will now be described, which can be obtained with a relatively simple and mainly analog operating apparatus (FIGS. 4 and 5). It fundamentally relates to the technique according to FIG. 1 wherein the electronic circuits 4.1 . . . 6 by halving one or more times the frequency of each fundamental tone producing undertones which are 1, 2, etc. octaves lower than said fundamental tone. Then, relative to FIGS. 5 and 6, brief reference will be made to digital versions, which enable the production of a larger variety of overtones and undertones and which also offer more adjustment possibilities.

Figure 2A:
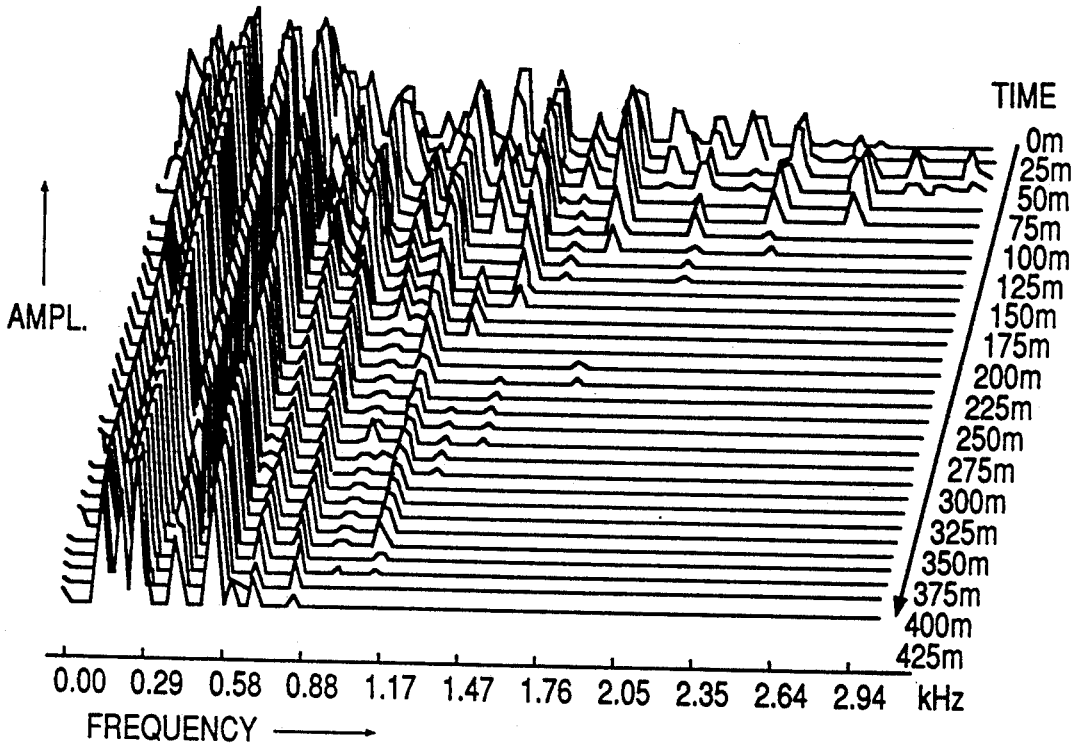
FIGS. 2*a* and *b* are graphical representation of frequency analyses of the tone of a string (2*a*) and a corresponding undertone (2*b*) produced in accordance with the invention.

FIGS. 2*a* and *b* show, for the purpose of illustrating the process with only one undertone per string, a three-dimensional frequency analysis of the played DAD chord (FIG. 2*a*), picked up at the outputs 10.1 . . . 6 and a corresponding undertone with half the frequency of the fundamental tone of the lowest string tone (FIG. 2*b*) picked up at the output 7. The representations show a frequency axis with a left to right rising frequency in kHz, an intensity axis with a bottom to top rising intensity and a time axis with rear to front advancing time.

FIG. 2*a* shows the fundamental tones of the three played sounds D, A and D at 150, 225 and 300 Hz, as well as the overtones also contained in the sound of the chord. The representation makes it clear that the frequency spectrum of the original sound so-to-speak contains no undertones, so that the admixing of undertones enriches the sound pattern.

Figure 2B:
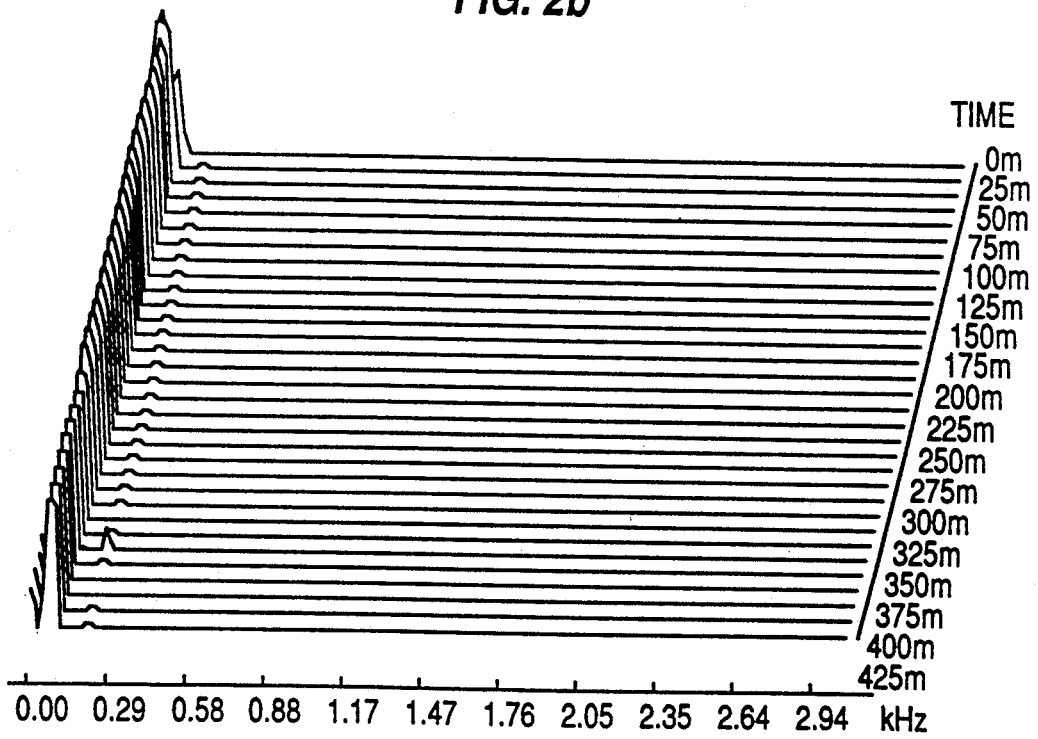

The 75 Hz undertone shown FIG. 2*b* is produced using the inventive process, in that a single undertone per string is produced and the priority logic only releases for amplification the undertone of the lowest played string tone. FIG. 2*b* shows that the undertone is filtered to an almost pure sine.

The undertone derived from the fundamental tone of the frequency mix (spectrum according to FIG. 2*a*) shown in FIG. 2*b* is produced in the unit 4, described as an electronic circuit in conjunction with FIG. 1. The input signal fed into the unit 4 is a sound, the output signal or signals a tone and both are analog, periodic signals. The electronic unit 4 is controlled by priority logic 5. A preferred embodiment for processing the input signal into the output signal in the electronic circuit 4 operates via a digital intermediate signal and is shown in greater detail in FIG. 3. It is possible to see the part corresponding to a string 1 and a pick-up 2. Corresponding arrangements can be provided for all other installed pick-ups.

The sound picked up by the pick-up 2 from the string 1 and which represents a random periodic signal, is reduced to its fundamental tone in a filter 41. The signal is a more or less pure, sinusoidal signal with the frequency $\nu_o$ and an amplitude corresponding to the original sound intensity. This tone is digitized in the digitizing unit 42, so that at its output a square-wave signal is obtained of frequency $\nu_o$ and a standardized amplitude. In a frequency halving means 43.1, this signal is converted into a corresponding signal with half the frequency $\nu_o/2$. The output signal of the frequency halving means is supplied to an output unit 44.1, in which is produced the output signal for the output 40.1. The output signal of the frequency halving means 43.1 can also be supplied to a further frequency halving means 43.2, which produces therefrom a further square-wave signal with the frequency $\nu_o/4$, which is further processed by the output unit 44.2. Correspondingly, in further frequency halving means, it is possible to produce signals with the frequency $\nu_o/8$, $\nu_o 16$, $\nu_o/32$, which are further processed in further output units. FIG. 3 shows three frequency halving means 43.1/2/3. However, variants are conceivable, with only one, two or more frequency halving means.

The function of the output units 44.1/2/3 is to convert a square-wave signal of a specific frequency and a standardized amplitude into a sinusoidal signal of the same frequency and with an amplitude dependent on further parameters. These further parameters are the intensity (amplitude) of the fundamental tone, which is available as the output signal of a level detector 45 and the adjustable or fixed control criteria of the priority logic 5.

It is conceivable for the priority logic to control according to its own criteria each undertone produced from the same fundamental tone, but it is also conceivable that control thereof is based on common criteria. It is also conceivable for each output unit 44.1/2/3 to have a separate adjustment possibility (arrow E in FIG. 1), so that it can be adjusted by the musician.

For a simple variation which still provides adequate timbre modulatability and for this reason is preferred, only undertones with the frequency $\nu_o/2$ are produced from the tones picked up separately from each string. The priority logic is fixed (without adjustability by the musician) and only amplifies the undertones of the lowest of several simultaneously excited strings, e.g. proportionally to the intensity of the original sound, whilst the undertones of the higher played strings are not produced. If a lower string is played when a higher one is already excited, the undertone of the lower string is produced and that of the higher string is softly muted. The sound extension shown in FIG. 2 can be produced with this simple process variant. Modulation of the timbre is only possible by adjusting the mixer/amplifier 6, i.e. by modifying the intensity of the undertone compared with the intensity of the original sound.

A variant consists of producing the undertones of several lower strings. The timbre of the polyphonic sound comprising the original sound and the undertones can be modulated by the mixing ratio of the individual undertones and by the intensity of the mixed sound of the undertones compared with the intensity of the original sound.

As a result of the adjustability of the mixer/amplifier 6, the musician can choose between a quasi-unmodified sound of the solid-body guitar (with a very low intensity of the undertones), a full, rich sound (with low intensity of the undertones) and a similar sound with an audible bass content (with high intensity of the undertones), which can assume the function of a bass player. The adjustment possibilities consequently offer a wide timbre range.

The inventive apparatus in the function of the filter 1 is e.g. a low-pass filter, in the function of the digitizing unit 42, e.g. a dynamic Schmitt trigger with a hysteresis dependent on the signal strength and for the output unit 44 e.g. a VC amplifier (voltage controlled amplifier).

The filter 41 is adapted in the frequency range and width to the string for which it is used. The output unit 44 determines a lower threshold of the intensity of the original tone, at which an undertone is to be produced and an upper intensity, at which the intensity of the undertone is no longer to be proportionally increased. It is also conceivable to incorporate into the output unit 44 a function subjecting the undertone to a time envelope curve.

The priority logic determines the priority code, i.e. it determines if several strings are to be played which of these is to produce the undertones (higher priority) and which will not fulfil this function (lower priority). It determines which intensity threshold the tone of a string must reach with low priority so that its undertone is switched on or off and determines the ratio of the undertones as a function of the intensities of the original string tones. It also determines the softness of the switching transitions and the envelope curve parameters for amplifying the undertones.

FIGS. 4 and 5 show a circuit diagram with the inventive apparatus but without the pick-up as a black box (FIG. 4) and a circuit diagram of an embodiment of the inventive apparatus (FIG. 5), which corresponds to the black box of FIG. 4. It is an embodiment in which an undertone is produced for each of three strings. The functions of the individual parts of the circuit can be gathered from table I (columns 1 and 2).

A special feature of the circuit shown in FIGS. 4 and 5 is the digitizing unit 44, which essentially comprises a Schmitt trigger with a dynamic hysteresis, which is realized by a single operational amplifier I12 and four diodes D10 to D13.

Numerous other possibilities for functions and adjustment possibilities can be achieved with purely digital processing methods, such as are e.g. permitted by DSP equipment (Digital Signal Processors) or "Guitar to MIDI" (Musical Intelligent Digital Interface) equipment. It is possible to realise in software manner on such or similar equipment the idea of enrichment by undertones and/or overtones and the idea of the adjustability of priority and amplification criteria, as listed in table I, column 3.

Figure 6:
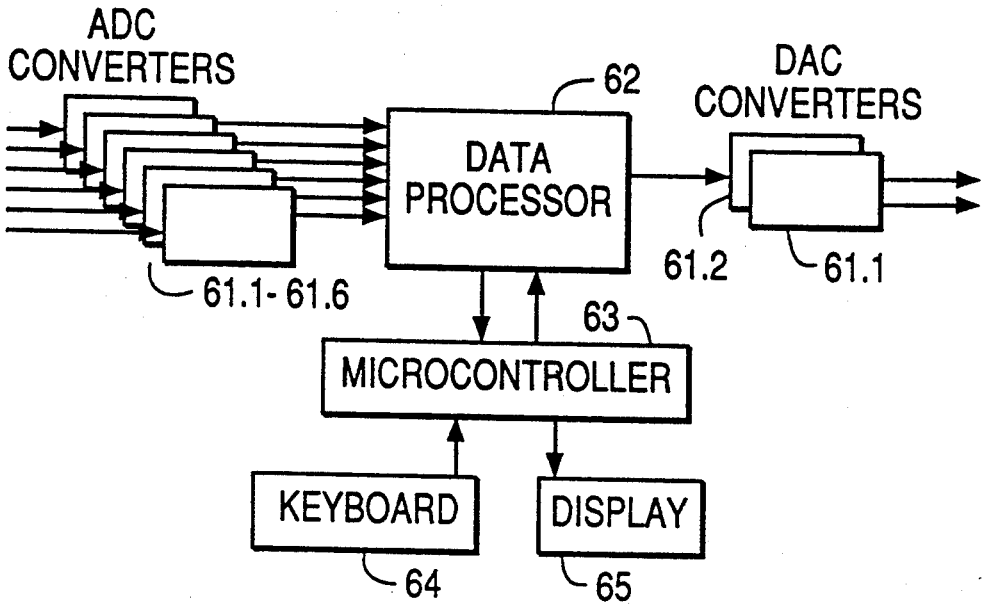
FIG. 6 is a schematic block diagram of a purely digital embodiment of the invention.

FIG. 6 shows a diagram for such a digital circuit. The sounds produced by the springs are picked up and individually digitized in ADC (Analog to Digital) converters 61.1 . . . 6 and e.g. are supplied to a data processing unit 62, which is controlled by a microcontroller 63, which is in turn operated by means of a keyboard 64 and a display 65. The functions of the inventive process are defined in a corresponding software and adjustments take place by means of the control system. The digital signals at the output of the unit 62 are converted in at least one DAC (Digital to Analog) converter 66.1, etc. to a mixed sound of undertones and/or overtones. Such an arrangement and corresponding software permits the variation possibilities of the priority logic listed in table I, as well as other functions given in table I, column 3, with their significance for the musician.

Figure 7:
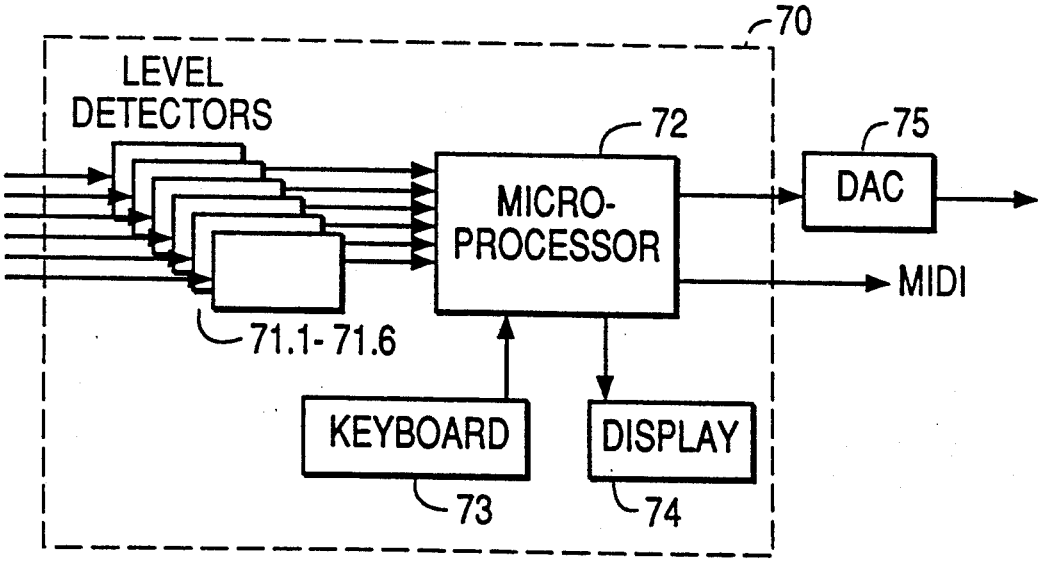
FIG. 7 is a schematic block diagram of a system for performing the inventive process using a "Guitar to MIDI" apparatus.

FIG. 7 shows a system in which a known Guitar to MIDI apparatus 70 is used. Such apparatuses comprising string-specific level detectors 71.1 . . . 6 and a microprocessor 72 operatable by means of a keyboard 73 and a display 74 are specialized for the guitar and all have a hexaphonic input. The processor does not process sounds, but merely the square-wave signal of the fundamental tone of each string and its level. From this and using simple software one or more strings can be chosen according to a priority logic and the frequency of the corresponding fundamental tone can be inventively multiplied by a simple fraction. The thus produced signal with a set level is supplied to a DAC 75, which is an inexpensive hardware edition, which may not be necessary in the case of equipment having incorporated synthesizers.

TABLE 1

| Modules and their Parameters | Responsible Component in Analog Version | Musician-Adjustable in Digital Version |
|---|---|---|
| Filter 41: | | |
| Frequency | R102/103 | To be adapted to the string pitch and tonal range |
| Q | C102/103 | |
| Digitizing Unit (Dynamic Hysteresis) 42: | | |
| Minimum hysteresis | R106 | not useful |
| Difference hysteresis - peak level | R110 | |
| Time constant peak det. | C105 | |
| Discharge curve | R90-93 | |
| Level Detector 45: | | |
| Time constant decay | C109/R120 | To be adapted to the string pitch and tonal range |
| Output Unit 44: | | |
| Maximum level (compression effect) | R106 | useful |
| Offset for minimum level (gate effect) | R119 | useful |
| Envelope curve | — | interesting |

TABLE 1-continued

| Modules and their Parameters | Responsible Component in Analog Version | Musician-Adjustable in Digital Version |
|---|---|---|
| Priority 5: | | |
| Priority code | Diode network | very interesting |
| Threshold for disabling lower priority strings | D15 | useful |
| Threshold for enabling lower priority strings | D15 | interesting |
| Displacement of upper thresholds by lower priority string levels | — | interesting |
| Softness of switching transitions | R121 | rather unnecessary |
| Dependence of envelope curves | — | interesting |
| Mixer 6. | | |
| Mixing ratio of all undertones | R117 | possible |
| Original sound - sum of undertones | Potentiometer P1 | obvious |

I claim:

1. A method for enhancing the sound of a string instrument by extending the frequency range of the sound produced comprising the steps of detecting the fundamental tones produced by each of a plurality of strings of the instrument, electronically generating at least one overtone or undertone for each of the plurality of strings, each said overtone or undertone being a harmonic of the fundamental tone of its associated string, controlling the intensity and time pattern of each said harmonic overtone or undertone as a function of the intensity of the fundamental tone and of a predetermined priority logic, and mixing the controlled harmonic tones with the originally produced fundamental tones.

2. A method according to claim 1 wherein the intensity and time pattern of each said harmonic overtone or undertone is adjustable by a musician playing the string instrument.

3. A method according to claim 1 and including established lower and upper limits for the intensity of the original string sound, and wherein the step of controlling includes amplifying the harmonic tones as a function of the intensity of the original sound between the predetermined upper and lower limits, providing no amplification below the lower limit and amplifying by a constant amplification factor above the upper limit.

4. A method according to claim 1 wherein each harmonic tone is amplified in accordance with a predetermined and adjustable amplification function.

5. A method according to claim 1 wherein a tone with a lower priority is muted when a tone with a higher priority is produced.

6. A method according to claim 1 wherein the step of controlling includes concomitantly controlling the priorities of the generated tones as a function of the ratios of the intensities of the fundamental tones produced by the instrument strings.

7. A method according to claim 1 wherein the step of generating includes halving the frequency of the fundamental tone to produce a harmonic undertone one octave below the fundamental tone, and wherein the priority logic gives a higher priority to tones produced by lower frequency played strings than to higher frequency played strings.

8. An apparatus for enhancing the sound of a string instrument played by a musician comprising the combination of a plurality of pickup means for detecting the fundamental frequency of the tone produced by each string of the instrument as it is played and for covering each tone into an electrical tone signal;

tone multiplication circuit means for multiplying each said tone signal by a selected factor to generate a plurality of harmonic tone signals representative of overtones or undertones of the fundamental tone;

means for amplifying said harmonic tone signals;

means for selectively controlling the amplifications of said harmonic tone signals in accordance with a predetermined relationship including the relative intensities of said tones produced by said springs;

means for mixing signals representative of said tones produced by said strings and said harmonic tone signals to produced mixed signals as the enhanced output.

9. An apparatus according to claim 8 and including speaker means for reproducing sound resulting from said mixed signals.

10. An apparatus according to claim 8 wherein each said tone multiplication circuit means includes a filter for filtering said tone signal, a digitizing circuit for digitizing signals filtered by said filter, at least one frequency divider for halving the frequency of said digitized signals and an output circuit, and wherein said means for controlling includes priority logic means for establishing a priority between tone signals.

11. An apparatus according to claim 10 wherein each said digitizing circuit includes a Schmitt trigger with dynamic hysteresis comprising an operational amplifier with four diodes.

12. An apparatus according to claim 8 wherein each said tone multiplication circuit means includes means for digitizing each tone signal, data processing means for amplifying and scaling said signals in accordance with a controllable program, and means for converting the amplified and scaled signals into analog form.

* * * * *